US009125273B2

(12) United States Patent
Jung et al.

(10) Patent No.: US 9,125,273 B2
(45) Date of Patent: Sep. 1, 2015

(54) LOAD DRIVING APPARATUS RELATING TO LIGHT-EMITTING-DIODES

(71) Applicant: Beyond Innovation Technology Co., Ltd., Taipei (TW)

(72) Inventors: Kuang-Yu Jung, Taipei (TW); Chiu-Yuan Lin, Taipei (TW)

(73) Assignee: Beyond Innovation Technology Co., Ltd., Taipei (TW)

( * ) Notice: Subject to any disclaimer, the term of this patent is extended or adjusted under 35 U.S.C. 154(b) by 203 days.

(21) Appl. No.: 13/959,762

(22) Filed: Aug. 6, 2013

(65) Prior Publication Data

US 2014/0145627 A1 May 29, 2014

(30) Foreign Application Priority Data

Nov. 29, 2012 (TW) ..... 101144828 A

(51) Int. Cl.

| | |
|---|---|
| ***H05B 37/00*** | (2006.01) |
| ***H05B 39/00*** | (2006.01) |
| ***H05B 41/00*** | (2006.01) |
| ***H05B 33/08*** | (2006.01) |

(52) U.S. Cl.

CPC ..... *H05B 33/0851* (2013.01); *H05B 33/0818* (2013.01)

(58) Field of Classification Search

USPC ..... 315/119, 210, 186

See application file for complete search history.

(56) References Cited

U.S. PATENT DOCUMENTS

| | | | | |
|---|---|---|---|---|
| 8,624,527 | B1 * | 1/2014 | Meir et al. | 315/318 |
| 8,994,276 | B2 * | 3/2015 | Recker et al. | 315/160 |
| 2009/0079357 | A1 * | 3/2009 | Shteynberg et al. | 315/291 |
| 2011/0267375 | A1 * | 11/2011 | Yang et al. | 345/690 |
| 2011/0316510 | A1 * | 12/2011 | Oshima | 323/282 |
| 2012/0236121 | A1 * | 9/2012 | Park et al. | 348/46 |
| 2012/0249740 | A1 * | 10/2012 | Lee et al. | 348/46 |
| 2012/0249797 | A1 * | 10/2012 | Haddick et al. | 348/158 |
| 2013/0193873 | A1 * | 8/2013 | Isaacson et al. | 315/294 |
| 2013/0222543 | A1 * | 8/2013 | Bae et al. | 348/46 |
| 2013/0229491 | A1 * | 9/2013 | Kim et al. | 348/46 |
| 2014/0028197 | A1 * | 1/2014 | van de Ven | 315/150 |
| 2014/0062319 | A1 * | 3/2014 | Huang et al. | 315/186 |
| 2014/0070710 | A1 * | 3/2014 | Harris | 315/185 R |
| 2014/0145627 | A1 * | 5/2014 | Jung et al. | 315/186 |
| 2014/0166858 | A1 * | 6/2014 | Lee | 250/208.1 |
| 2014/0210350 | A1 * | 7/2014 | Yang et al. | 315/122 |
| 2014/0217474 | A1 * | 8/2014 | Lee et al. | 257/225 |
| 2014/0252927 | A1 * | 9/2014 | Denny et al. | 312/209 |
| 2014/0265866 | A1 * | 9/2014 | Julicher et al. | 315/149 |
| 2015/0054338 | A1 * | 2/2015 | Mohammed Suhura et al. | 307/23 |
| 2015/0054863 | A1 * | 2/2015 | Tanaka et al. | 345/691 |
| 2015/0069914 | A1 * | 3/2015 | Pop | 315/113 |
| 2015/0069926 | A1 * | 3/2015 | Lee et al. | 315/209 R |
| 2015/0097489 | A1 * | 4/2015 | Wu et al. | 315/122 |

* cited by examiner

*Primary Examiner* — Adam Houston

(74) *Attorney, Agent, or Firm* — Jianq Chyun IP Office

(57) ABSTRACT

A load driving apparatus relating to light-emitting-diodes (LEDs) is provided. In the invention, a compensation voltage on a compensation pin (CMP) of a control chip does not change in response to (or with) the variation (i.e. enabling and disabling) of a pulse-width-modulation (PWM) signal for dimming. In other words, regardless of whether the PWM signal for dimming is enabled or disabled, the compensation voltage on the compensation pin of the control chip maintains unchanged. Therefore, an LED string at the current switching transient does not have the generation of over-shoot current.

15 Claims, 4 Drawing Sheets

LOAD DRIVING APPARATUS RELATING TO LIGHT-EMITTING-DIODES

CROSS-REFERENCE TO RELATED APPLICATION

This application claims the priority benefit of Taiwan application serial no. 101144828, filed on Nov. 29, 2012. The entirety of the above-mentioned patent application is hereby incorporated by reference herein and made a part of this specification.

BACKGROUND OF THE INVENTION

1. Field of the Invention

The invention relates to a capacitive load driving technology, and more particularly, to a load driving apparatus relating to light-emitting-diodes (LEDs).

2. Description of Related Art

In a conventional load driving apparatus for LEDs, a current mode control chip may be provided with a pulse-width-modulation (PWM) dimming function, which may be used to adjust the luminance of an LED string. On the other hand, in order to stabilize a DC voltage required for operations of the LED string, an RC series network is usually attached externally on a compensation pin (CMP) of a control chip, so as to compensate a compensation voltage on the compensation pin of the control chip. However, since the compensation voltage on the compensation pin of the control chip changes in response to (or with) the variation (i.e. enabling and disabling) of a pulse-width-modulation (PWM) signal for dimming, an over-shoot current is likely to be generated by the LED string at the current switching transient.

SUMMARY OF THE INVENTION

Accordingly, in order to solve the problems as mentioned in the as mentioned in Description of Related Art, an embodiment of the invention provides a load driving apparatus which includes a power conversion circuit, a dimming circuit, a control chip and a compensation circuit. The power conversion circuit is configured to provide a DC output voltage to an LED string. The dimming circuit is connected in series with the LED string, and configured to adjust a luminance of the LED string.

The control chip is coupled to the power conversion circuit and the dimming circuit, and configured to: generate the gate PWM signal in response to a comparison between a compensation voltage and a ramp signal to control operations of the power conversion circuit; generate the dimming output PWM signal in response to a dimming input PWM signal to control operations of the dimming circuit; and transfer the compensation voltage to a compensation pin of the control chip in response to an enabling of the dimming input PWM signal.

The compensation circuit is coupled to the compensation pin, and configured to store the compensation voltage and compensate the compensation voltage so that the power conversion circuit stably provides the DC output voltage. Particularly, the control chip is further configured to stop transferring the compensation voltage to the compensation pin in response to a disabling of the dimming input PWM signal, such that the compensation voltage stored by the compensation circuit does not change with variation (i.e., enabling and disabling) of the dimming output PWM signal.

In an exemplary embodiment of the invention, the power conversion circuit is further configured to receive a DC input voltage and provide the DC output voltage to the LED string in response to the gate PWM signal. In this condition, the power conversion circuit may be a DC boost circuit, and the DC boost circuit includes an inductor, a first capacitor, a power switch and a first resistor. A first terminal of the inductor is configured to receive the DC input voltage. An anode of the diode is coupled to a second terminal of the inductor, and a cathode of the diode is coupled to an anode of the LED string to provide the DC output voltage. A first terminal of the first capacitor is coupled to the cathode of the diode, and a second terminal of the first capacitor is coupled to a ground potential. A drain of the power switch is coupled to the second terminal of the inductor and the anode of the diode, and a gate of the power switch is configured to receive the gate PWM signal. The first resistor is coupled between a source of the power switch and the ground potential.

In an exemplary embodiment of the invention, the dimming circuit is configured to adjust a luminance of the LED string in response to the dimming output PWM signal, and the dimming circuit includes a dimming switch and a second resistor. A drain of the dimming switch is coupled to a cathode of LED string, and a gate of the dimming switch is configured to receive the dimming output PWM signal. The second resistor is coupled between a source of the dimming switch and the ground potential.

In an exemplary embodiment of the invention, the compensation circuit includes a second capacitor and a third resistor. A first terminal of the second capacitor is coupled to the compensation pin. The third resistor is coupled between a second terminal of the second capacitor and the ground potential.

In the present exemplary embodiment of the invention, the control chip includes an operational transconductance amplifier (OTA), a gate signal generation unit, a dimming signal generation unit and a switching unit. The operational transconductance amplifier is configured to receive a cross-voltage of the second resistor and a predetermined dimming reference voltage, so as to generate the compensation voltage accordingly. The gate signal generation unit is coupled to the operational transconductance amplifier, and configured to receive the compensation voltage and the ramp signal and compare the compensation voltage with the ramp signal in response to the enabling of the dimming input PWM signal, so as to generate the gate PWM signal The dimming signal generation unit is configured to receive the dimming input signal and buffer-output the dimming input PWM signal, so as to generate the dimming output PWM signal. The switching unit is coupled the operational transconductance amplifier, and configured to receive the compensation voltage and transfer the compensation voltage to the compensation pin in response to the enabling of the dimming input PWM signal. Particularly, the switching unit is further configured to stop transferring the compensation voltage to the compensation pin in response to the disabling of the dimming input PWM signal; in addition, the gate signal generation unit is further configured to stop generating the gate PWM signal in response to the disable state of the dimming input PWM signal.

In the present exemplary embodiment of the invention, the control chip further has a gate output pin, and the gate signal generation unit may output the gate PWM signal via the gate output pin to control switching of the power switch.

In the present exemplary embodiment of the invention, the control chip further has a dimming input pin, and the dimming signal generation unit receives the dimming input PWM signal via the dimming input pin.

In the present exemplary embodiment of the invention, the control chip further has a dimming output pin, and the dimming signal generation unit outputs the dimming output PWM signal via the dimming output pin to control switching of the dimming switch.

In an exemplary embodiment of the invention, the control chip further has a dimming detection pin, and the operational transconductance amplifier receives the cross-voltage of the second resistor via the dimming detection pin.

In an exemplary embodiment of the invention, the gate signal generation unit is further configured to determine whether to activate an over current protection mechanism according to a cross-voltage of the first resistor and a predetermined over current protection reference voltage. In this condition, the gate signal generation unit is further configured to stop generating the gate PWM signal in response to the activation of the over current protection mechanism.

In an exemplary embodiment of the invention, the control chip further has a current sense pin, and the gate signal generation unit receives the cross-voltage of the first resistor via the current sense pin.

In an exemplary embodiment of the invention, said load driving apparatus further includes an output feedback unit. The output feedback unit is coupled between the DC output voltage and the ground potential, and configured to provide a feedback voltage relating to the DC output voltage. In this condition, the gate signal generation unit is further configured to determine whether to activate an over voltage protection mechanism in response to the feedback voltage and a predetermined over voltage protection reference voltage. And, the gate signal generation unit is further configured to stop generating the gate PWM signal in response to the activation of the over voltage protection mechanism.

In an exemplary embodiment of the invention, the control chip further has a voltage sense pin, and the gate signal generation unit receives the feedback voltage via the voltage sense pin.

In an embodiment of the invention, the control chip further has a power pin configured to receive the DC input voltage required for operations.

In an embodiment of the invention, the control chip further has a ground pin coupled to the ground potential.

Based on above, in the invention, the compensation voltage on the compensation pin of the control chip does not change in response to (or with) variation (enabling or disabling) of the PWM signal for dimming (i.e., the dimming output PWM signal). In other words, regardless of whether the PWM signal for dimming (i.e., the dimming output PWM signal) is enabled or disabled, the compensation voltage on the compensation pin of the control chip maintains unchanged. Therefore, the LED string at the current switching transient does not have the generation of over-shoot current, so as to solve the problems as mentioned in Description of Related Art.

However, the above descriptions and the below embodiments are only used for explanation, and they do not limit the scope of the invention.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
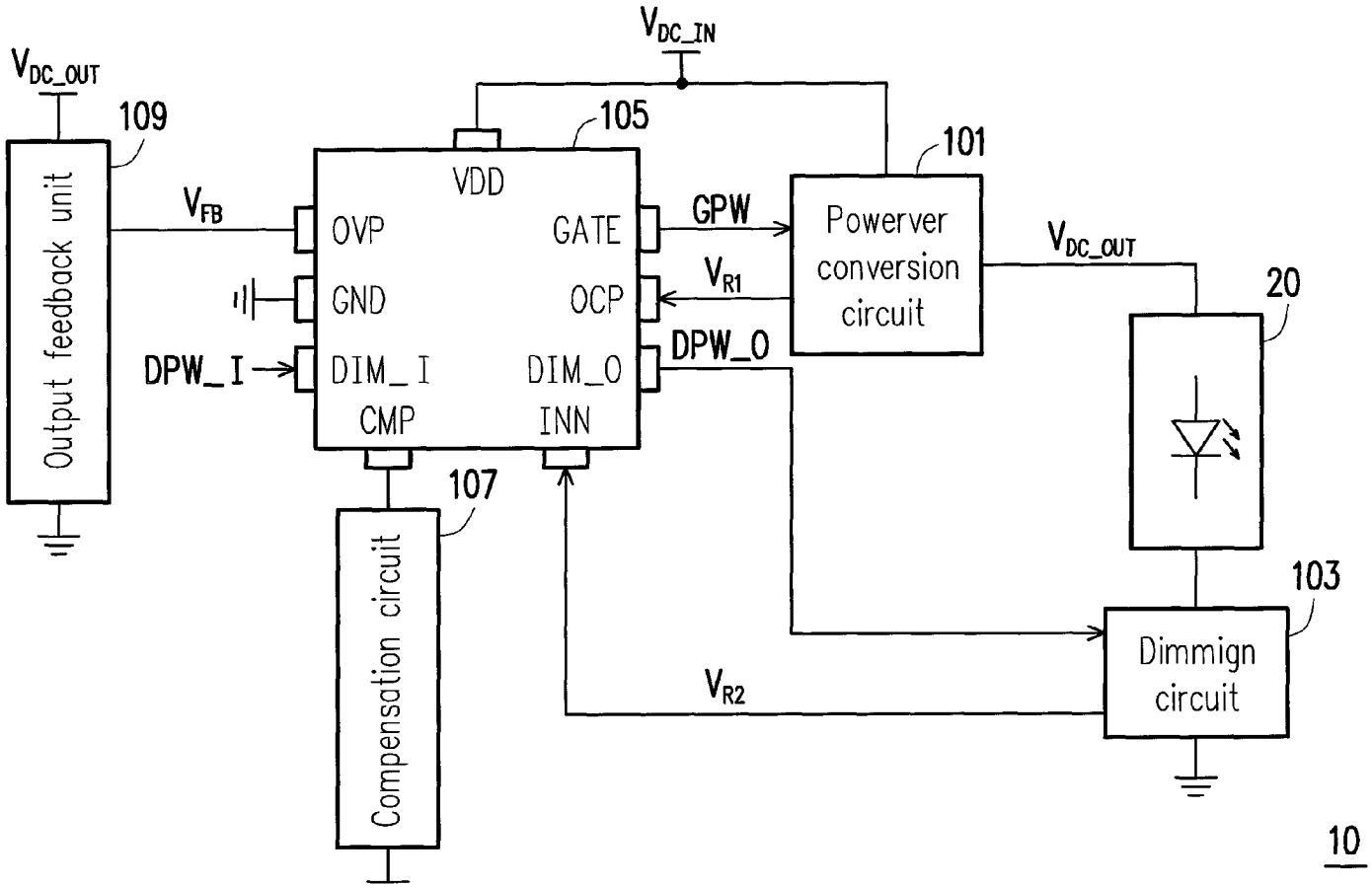
FIG. 1 is a schematic diagram illustrating a load driving apparatus 10 according to an exemplary embodiment of the invention.

Descriptions of the invention are given with reference to the exemplary embodiments illustrated with accompanied drawings, wherein same or similar parts are denoted with same reference numerals. In addition, whenever possible, identical or similar reference numbers stand for identical or similar elements in the figures and the embodiments.

Figure 2:
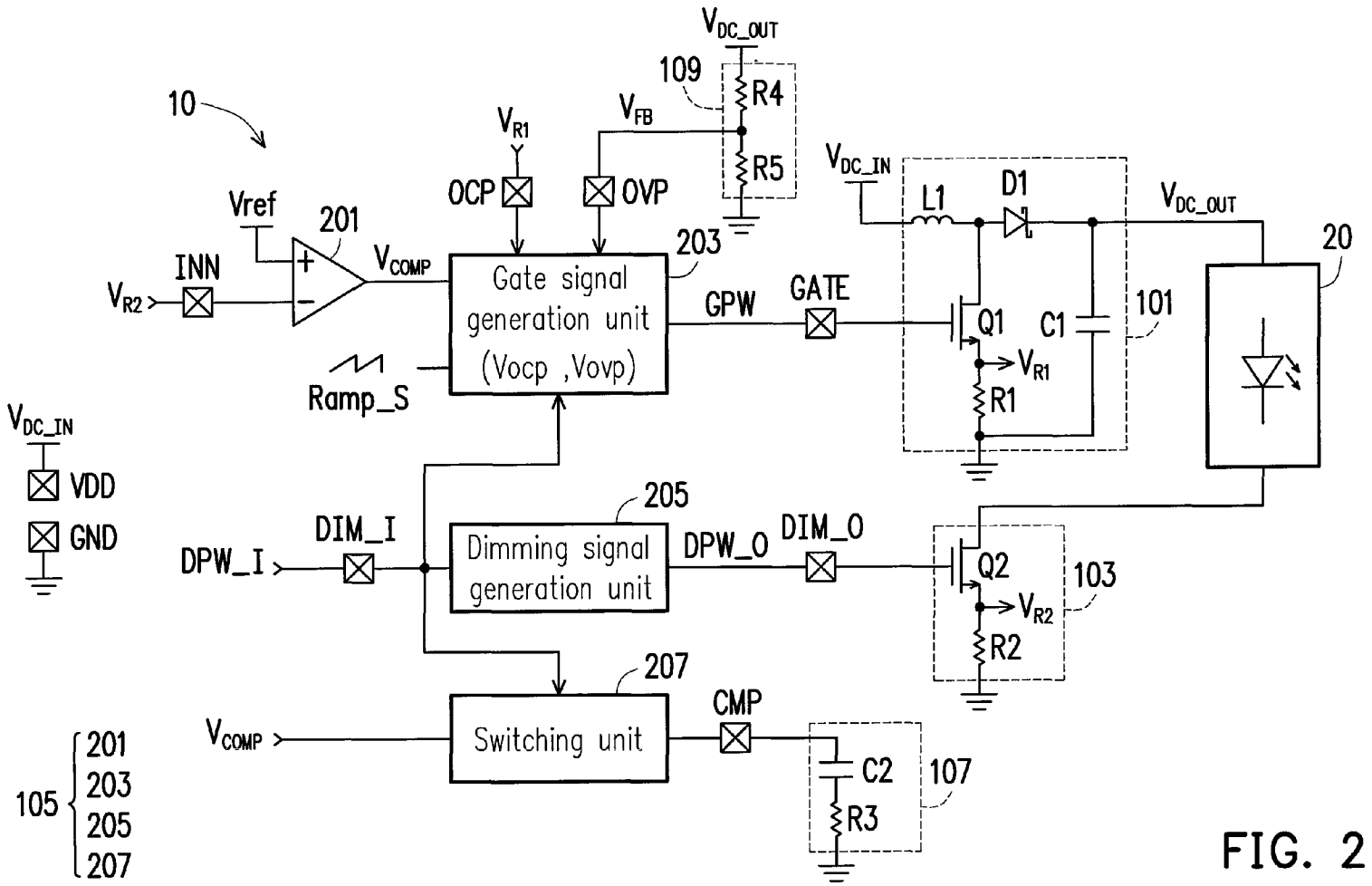
FIG. 2 is a schematic diagram illustrating an implementation of the load driving apparatus 10 depicted in FIG. 1.

FIG. 1 is a schematic diagram illustrating a load driving apparatus 10 according to an exemplary embodiment of the invention, and FIG. 2 is a schematic diagram illustrating an implementation of the load driving apparatus 10 depicted in FIG. 1. Referring to FIG. 1 and FIG. 2 together, the load driving apparatus 10 includes a power conversion circuit 101, a dimming circuit 103, a (current-mode) control chip 105, a compensation circuit 107 and an output feedback unit 109.

The power conversion circuit 101 is configured to receive a DC input voltage $V_{DC_IN}$ and provide a DC output voltage $V_{DC_OUT}$ to at least an LED string 20 (i.e., a plurality of LEDs connected together in forward series) in response to a gate pulse-width-modulation signal (gate PWM signal) GPW from the control chip 105.

In the present exemplary embodiment, the power conversion circuit 101 may be a DC boost circuit, which may include an inductor L1, a diode (such as a Schottky diode, but the invention is not limited thereto) D1, a capacitor C1, an (N-type) power switch Q1 and a resistor R1.

A first terminal of the inductor L1 is configured to receive the DC input voltage $V_{DC_IN}$. An anode of the diode D1 is coupled to a second terminal of the inductor L1, and a cathode of the diode D1 is coupled to an anode of the LED string 20 to provide the DC output voltage $V_{DC_OUT}$. A first terminal of the capacitor C1 is coupled to the cathode of the diode D1 and a second terminal of the capacitor C1 is coupled a ground potential. A drain of the (N-type) power switch Q1 is coupled to the second terminal of the inductor L1 and the anode of the diode D1, and a gate of the (N-type) power switch Q1 is configured to receive the gate PWM signal GPW from the control chip 105. The resistor R1 is coupled between a source of the (N-type) power switch Q1 and the ground potential.

On the other hand, the dimming circuit 103 is connected in series with the LED string 20, and configured to adjust a luminance/brightness of the LED string 20 in response to a dimming output PWM signal DPW_O from the control chip 105. In the present exemplary embodiment, the dimming circuit 103 may include an (N-type) dimming switch Q2 and a resistor R2. A drain of the (N-type) dimming switch Q2 is coupled to a cathode of LED string 20, and a gate of the (N-type) dimming switch Q2 is configured to receive the dimming output PWM signal DPW_O from the control chip 105. The resistor R2 is coupled between a source of the (N-type) dimming switch Q2 and the ground potential.

The control chip 105 is coupled to the power conversion circuit 101 and the dimming circuit 103, and configured to: 1) generate the gate PWM signal GPW in response to a comparison between a compensation voltage VCOMP and a ramp signal Ramp_S to control operations of the power conversion circuit 101; 2) generate the dimming output PWM signal DPW_O in response to a dimming input PWM signal DPW_I to control operations of the dimming circuit 103; and 3) transfer the compensation voltage $V_{COMP}$ to a compensation pin CMP of the control chip 105 in response to an enabling of the dimming input PWM signal DPW_I. Moreover, the control chip 105 may be further configured to: 4) stop transferring the compensation voltage $V_{COMP}$ to the compensation pin CMP in response to a disabling of the dimming input PWM signal DPW_I.

Basically, in order to ensure that the control chip 105 operates normally, the control chip 105 may have a power pin VDD to receive the DC input voltage $V_{DC_IN}$ required for operations, and may have a ground pin GND coupled to the ground potential. Accordingly, the control chip 105 may perform a conversion (e.g., boosting/bucking) to the DC input voltage $V_{DC_IN}$, so as to obtain an operating voltage required for internal circuits thereof.

In the present exemplary embodiment, the control chip 105 may include an operational transconductance amplifier (OTA) 201, a gate signal generation unit 203, a dimming signal generation unit 205 and a switching unit 207. Among them, the operational transconductance amplifier (OTA) 201 is configured to receive a cross-voltage $V_{R2}$ of the resistor R2 and a predetermined dimming reference voltage Vref, so as to generate the compensation voltage $V_{COMP}$.

In other words, a positive input terminal (+) of the operational transconductance amplifier (OTA) 201 is configured to receive the predetermined dimming reference voltage Vref; a negative input terminal (−) of the operational transconductance amplifier (OTA) 201 is configured to receive the cross-voltage $V_{R2}$ of the resistor R2; and an output terminal of the operational transconductance amplifier (OTA) 201 is configured to generate and output the compensation voltage $V_{COMP}$. In the present exemplary embodiment, the control chip 105 may further have a dimming detection pin INN, and the operational transconductance amplifier (OTA) 201 may receive the cross-voltage $V_{R2}$ of the resistor R2 via the dimming detection pin INN. The voltage $V_{R2}$ feedbacked to the dimming detection pin INN of the control chip 105 may substantially be similar to the predetermined dimming reference voltage Vref, but the invention is not limited thereto.

The gate signal generation unit 203 is coupled to the operational transconductance amplifier (OTA) 201, and configured to receive the compensation voltage $V_{COMP}$ and the ramp signal Ramp_S and compare the compensation voltage $V_{COMP}$ with the ramp signal Ramp_S in response to the enabling of the dimming input PWM signal DPW_I, so as to generate the gate PWM signal GPW. In addition, the gate signal generation unit 203 is further configured to stop generating the gate PWM signal GPW in response to the disabling of the dimming input PWM signal DPW_I. In the present exemplary embodiment, the control chip may further have a gate output pin GATE, and the gate signal generation unit 203 may output the gate PWM signal GPW via the gate output pin GATE to control switching of the (N-type) power switch Q1.

The dimming signal generation unit 205 is configured to receive the dimming input PWM signal DPW_I and buffer-output the dimming input PWM signal DPW_I, so as to generate the dimming output PWM signal DPW_O. In the present exemplary embodiment, the dimming signal generation unit 205 may be implemented by adopting at least two inverters connected in series, but the invention is not limited thereto. Apparently, the dimming output PWM signal DPW_O is substantially identical to the dimming input PWM signal DPW_I. Moreover, the control chip 105 may further have a dimming input pin and the dimming signal generation 205 may receive the dimming input PWM signal DPW_I via the dimming input pin DIM_I; in addition, the control chip 105 may further have a dimming output pin DIM_O, and the dimming signal generation 205 may output the dimming input PWM signal DPW_O via the dimming output pin DIM_O to control switching of the (N-type) dimming switch Q2.

The switching unit 207 is coupled to the operational transconductance amplifier (OTA) 201, and configured to receive the compensation voltage $V_{COMP}$ and transfer the compensation voltage $V_{COMP}$ to the compensation pin CMP in response to the enabling of the dimming input PWM signal DPW_I; in addition, the switching unit 207 may be further configured to stop transferring the compensation voltage $V_{COMP}$ to the compensation pin CMP in response to the disabling of the dimming input PWM signal DPW_I.

Figure 3A:
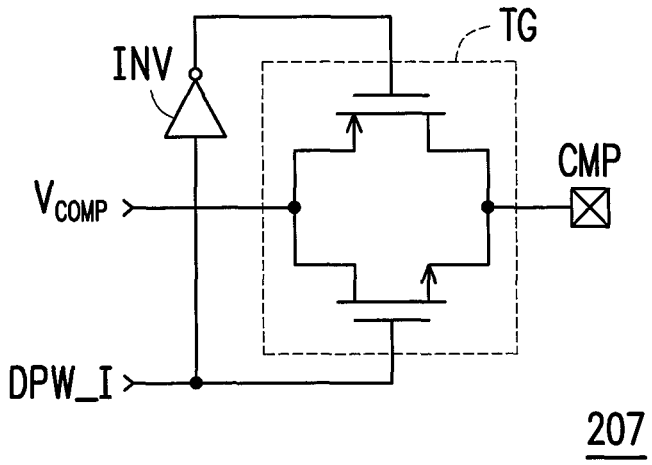
FIG. 3A is a schematic diagram illustrating an implementation of the switching unit 207 depicted in FIG. 2.
Figure 3B:
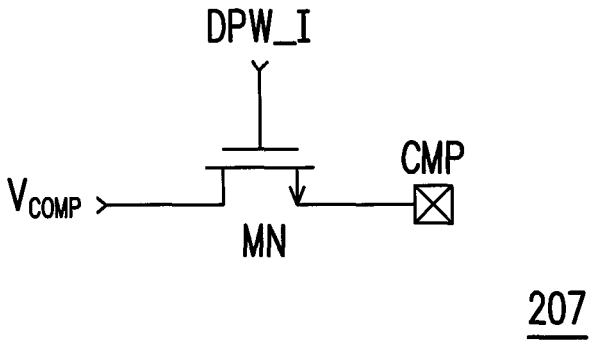
FIG. 3B is a schematic diagram illustrating another implementation of the switching unit 207 depicted in FIG. 2.

In the present exemplary embodiment, the switching unit 207 may be implemented by adopting a combination of a transmission gate TG and an inverter INV as shown in FIG. 3A, but the invention is not limited thereto. In other exemplary embodiments of the invention, the switching unit 207 may also be implemented by adopting a single N-type transistor switch MN, as shown in FIG. 3B. In other words, as long as existing functions of the switching unit 207 are present, implementations of the switching unit 207 may be changed according to the actual design/application requirements.

On the other hand, as shown in FIG. 2, the compensation circuit 107 is coupled to the compensation pin CMP of the control chip 105, and configured to store the compensation voltage $V_{COMP}$ and compensate the compensation voltage $V_{COMP}$, so that the power conversion circuit 101 stably provides the DC output voltage $V_{DC_OUT}$. In the present exemplary embodiment, the compensation circuit 107 may be an RC series network which includes a capacitor C2 and a resistor R3. A first terminal of the capacitor C2 is coupled to the compensation pin CMP, and the resistor R3 is coupled between a second terminal of the capacitor C2 and the ground potential. Of course, in other exemplary embodiments of the invention, the capacitor C2 and the resistor R3 may also be oppositely disposed, i.e., a first terminal of the resistor R3 is changed to couple to the compensation pin CMP, and the capacitor C2 is changed to couple between the second terminal of the resistor R3 and the ground potential.

It should be noted that, since the compensation circuit 107 may store the compensation voltage $V_{COMP}$ via the capacitor C2 in response to the enabling of the dimming input PWM signal DPW_I, and be in a floating state in response to the disabling of the dimming input PWM signal DPW_I. Thus, it can be known that, the compensation voltage $V_{COMP}$ stored by the compensation circuit 107 does not change with variation (i.e., enabling and disabling) of the dimming output PWM signal DPW_O. In other words, regardless of whether the dimming output PWM signal DPW_O is enabled or disabled, the compensation voltage $V_{COMP}$ on the compensation pin CMP of the control chip 105 maintains unchanged.

Besides, in order to avoid the LED string 20 and/or the internal elements/components of the load driving apparatus 10 from being damaged due to affection of an over current (OC), thus, in the present exemplary embodiment, the gate signal generation unit 203 may be further configured to determine whether to activate an OC protection mechanism in response to a cross-voltage $V_{R1}$ of the resistor R1 and a predetermined over current protection reference voltage Vocp. Once the gate signal generation unit 203 has determined to activate the OC protection mechanism, the gate signal generation unit 203 stops generating the gate PWM signal GPW in response to the activation of the OC protection mechanism, until no occurrence of the over current is found. In this condition, the control chip 105 may further have a current sense pin OCP, and the gate signal generation unit 203 may receive the cross-voltage $V_{R1}$ of the resistor R1 via the current sense pin OCP, so as to determine whether the over current occurs.

Moreover, in order to avoid the LED string 20 and/or the internal elements/components of the load driving apparatus 10 from being damaged due to affection of an over voltage (OV), thus, in the present exemplary embodiment, the control chip 105 may determine whether to activate an OV protection mechanism with reference to a feedback voltage $V_{FB}$ of the output feedback unit 109. In the present exemplary embodiment, the output feedback unit 109 is coupled between the DC output voltage $V_{DC_OUT}$ and the ground potential, and configured to provide the feedback voltage $V_{FB}$ relating to the DC output voltage $V_{DC_OUT}$.

More specifically, the output feedback unit 109 may include resistors R4 and R5. A first terminal of the resistor R4 is configured to receive the DC output voltage $V_{DC_OUT}$; a second terminal of the resistor R4 is configured to provide the feedback voltage $V_{FB}$; and the resistor R5 is coupled between the second terminal of the resistor R4 and the ground potential. Apparently, the feedback voltage $V_{FB}$ is a voltage-dividing signal of the DC output voltage $V_{DC_OUT}$, i.e., $V_{FB}=V_{DC_OUT}*(R5/(R4+R5))$.

Based on the feedback voltage $V_{FB}$ provided by the output feedback unit 109, the gate signal generation unit 203 may be further configured to determine whether to activate the OV protection mechanism in response to the feedback voltage $V_{FB}$ and a predetermined over voltage protection reference voltage Vovp. Once the gate signal generation unit 203 has determined to activate the OV protection mechanism, the gate signal generation unit 203 stops generating the gate PWM signal GPW in response to the activation of the OV protection mechanism, until no occurrence of the over voltage is found. In this condition, the control chip 105 may further have a voltage sense pin OVP, and the gate signal generation unit 203 may receive the feedback voltage $V_{FB}$ via the voltage sense pin OVP, so as to determine whether the over voltage occurs. Of course, in other exemplary embodiments of the invention, the gate signal generation unit 203 may also adjust the generated gate PWM signal GPW in response to the feedback voltage $V_{FB}$ provided by the output feedback unit 109, depending on the actual design/application requirements.

Figure 4:
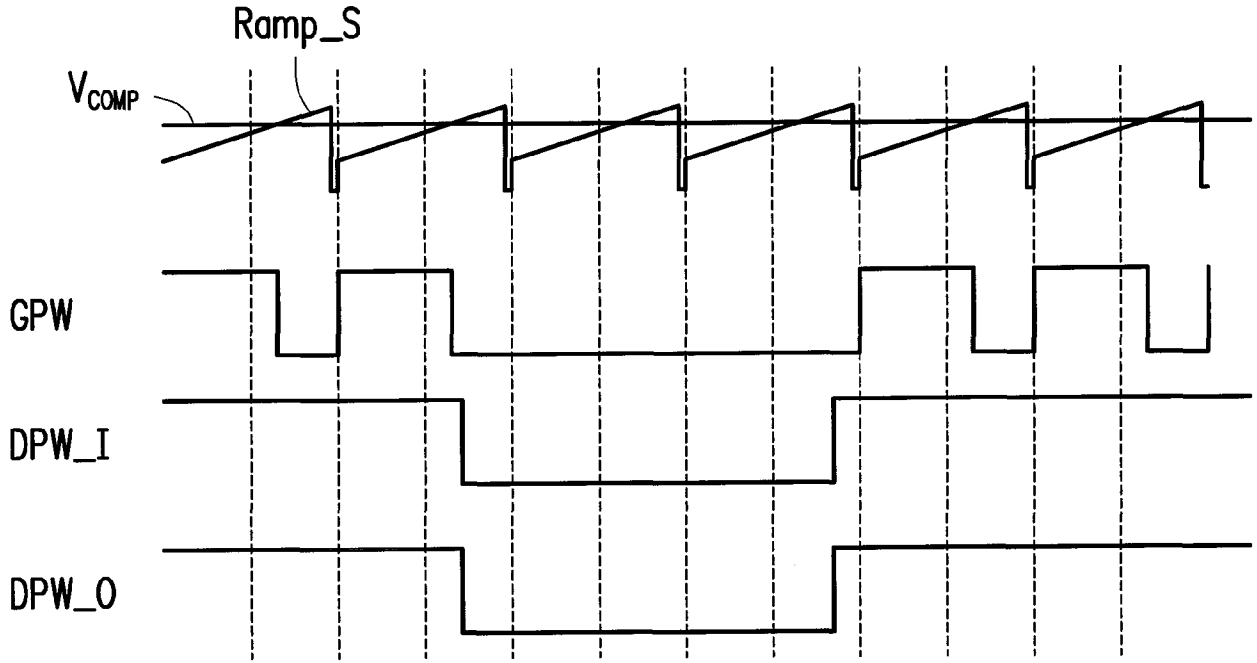
FIG. 4 is a waveform diagram illustrating a part of operations of the load driving apparatus 10 depicted in FIG. 1.

Based on above, as shown in FIG. 4, which is a waveform diagram illustrating a partial operation of the load driving apparatus 10 depicted in FIG. 1. Referring to FIG. 1 to FIG. 4 together, it is clearly shown in FIG. 4 that the dimming output PWM signal DPW_O is substantially identical to the dimming input PWM signal DPW_I. Furthermore, it should be noted that, "$V_{COMP}$" as marked in FIG. 4 is the compensation voltage $V_{COMP}$ stored by the compensation circuit 107, i.e., the compensation voltage Vamp on the compensation pin CMP of the control chip 105.

Accordingly, the gate signal generation unit 203 compares the compensation voltage $V_{COMP}$ with the ramp signal Ramp_S in response to the enabling of the dimming input PWM signal DPW_I, so as to generate the gate PWM signal GPW having a predetermined duty cycle to control switching of the (N-type) power switch Q1. In addition, the gate signal generation unit 203 may also stop generating the gate PWM signal GPW in response to the disabling of the dimming input PWM signal DPW_I. Apparently, adjustment to the luminance of the LED string 20 may be realized by applying the dimming input PWM signal DPW_I to the dimming input pin DIM_I of the control chip 105.

On the other hand, the switching unit 207 may transfer the compensation voltage $V_{COMP}$ to the compensation pin CMP in response to the enabling of the dimming input PWM signal DPW_I, so that the compensation circuit 107 stores and compensates the compensation voltage $V_{COMP}$, which allows the power conversion circuit 101 to stably provide the DC output voltage $V_{DC_OUT}$. In addition, the switching unit 207 may stop transferring the compensation voltage $V_{COMP}$ to the compensation pin CMP in response to the disabling of the dimming input PWM signal DPW_I. Accordingly, since the compensation circuit 107 is in the floating state, the compensation voltage $V_{COMP}$ stored by the compensation circuit 107 does not change with variation (i.e., enabling and disabling) of the dimming output PWM signal DPW_O. In other words, regardless of whether the dimming output PWM signal DPW_O is enabled or disabled, the compensation voltage $V_{COMP}$ on the compensation pin CMP of the control chip 105 maintains unchanged.

Subsequently, when dimming input PWM signal DPW_I changes from the disable state into the enable state, since the transmission gate TG in the switching unit 207 is turned on, and the operational transconductance amplifier (OTA) 201 has a relatively greater output impedance, a voltage on the output terminal of the operational transconductance amplifier (OTA) 201 immediately becomes the compensation voltage $V_{COMP}$ stored by the compensation circuit 107. Accordingly, the gate signal generation unit 203 may compare the compensation voltage $V_{COMP}$ with the ramp signal Ramp_S again in response to the enabling of the dimming input PWM signal DPW_I, so as to generate the gate PWM signal GPW having the same predetermined duty cycle to control switching of the (N-type) power switch Q1. Apparently, a reason that the LED string 20 at the current switching transient does not have the generation of over-shoot current is because the compensation voltage $V_{COMP}$ on the compensation pin CMP of the control chip 105 maintains unchanged, so that the gate signal generation unit 203 does not generate the full-ON (i.e., the duty cycle being 100%) gate PWM signal GPW when the LED string 20 is at the current switching transient.

Besides, during operations of the load driving apparatus 10, the gate signal generation unit 203 in the control chip 105 continues to monitor cross-voltages ($V_{R1}$, $V_{R5}$) of resistors R1 and R5, so as to determine whether the over current/over voltage occurs. Once the gate signal generation unit 203 has determined that occurrence of the over current and/or the over voltage is present/happened, the gate signal generation unit 203 immediately stops generating the gate PWM signal GPW, until no occurrence of the over current and/or the over voltage is found.

In light of above, in the invention, the compensation voltage $V_{COMP}$ on the compensation pin CMP of the control chip 105 does not change in response to (or with) variation (enabling or disabling) of the PWM signal for dimming (i.e., the dimming output PWM signal DPW_O). In other words, regardless of whether the PWM signal for dimming (i.e., the dimming output PWM signal DPW_O) is enabled or disabled, the compensation voltage $V_{COMP}$ on the compensation pin CMP of the control chip 105 maintains unchanged. Therefore, the LED string 20 at the current switching transient does not have the generation of over-shoot current, so as to solve the problems as mentioned in Description of Related Art.

It will be apparent to those skilled in the art that various modifications and variations can be made to the structure of the disclosed embodiments without departing from the scope or spirit of the disclosure. In view of the foregoing, it is intended that the disclosure cover modifications and variations of this specification provided they fall within the scope of the following claims and their equivalents.

Any of the embodiments or any of the claims of the invention does not need to achieve all of the advantages or features disclosed by the present invention. Moreover, the abstract and the headings are merely used to aid in searches of patent files and are not intended to limit the scope of the claims of the present invention.

What is claimed is:

1. A load driving apparatus, comprising:

a power conversion circuit configured to provide a DC output voltage to a light emitting diode string;

a dimming circuit connected in series with the light emitting diode string, and configured to adjust a luminance of the light emitting diode string;

a control chip coupled to the power conversion circuit and the dimming circuit, and configured to:

generate a gate pulse-width-modulation signal in response to a comparison between a compensation voltage and a ramp signal to control operation of the power conversion circuit;

generate a dimming output pulse-width-modulation signal in response to a dimming input pulse-width-modulation signal to control operation of the dimming circuit;

transfer the compensation voltage to a compensation pin of the control chip in response to an enabling of the dimming input pulse-width-modulation signal; and a compensation circuit coupled to the compensation pin, and configured to store the compensation voltage and compensate the compensation voltage so that the power conversion circuit stably provides the DC output voltage, wherein the control chip is further configured to stop transferring the compensation voltage to the compensation pin in response to a disabling of the dimming input pulse-width-modulation signal, such that the compensation voltage stored by the compensation circuit does not change with variation of the dimming output pulse-width-modulation signal.

2. The load driving apparatus of claim 1, wherein the power conversion circuit is further configured to receive a DC input voltage and provide the DC output voltage to the light emitting diode string in responding to the gate pulse-width-modulation signal.

3. The load driving apparatus of claim 2, wherein the power conversion circuit is at least a DC boost circuit, and the DC boost circuit comprises:

an inductor having a first terminal configured to receive the DC input voltage;

a diode having an anode coupled to a second terminal of the inductor, and a cathode coupled to an anode of the light emitting diode string to provide the DC output voltage;

a first capacitor having a first terminal coupled to the cathode of the diode, and a second terminal coupled to a ground potential;

a power switch having a drain coupled to the second terminal of the inductor and the anode of the diode, and a gate configured to receive the gate pulse-width-modulation signal; and a first resistor coupled between a source of the power switch and the ground potential.

4. The load driving apparatus of claim 3, wherein the dimming circuit is configured to adjust the luminance of the light emitting diode string in response to the dimming output pulse-width-modulation signal, and the dimming circuit comprises:

a dimming switch having a drain coupled to a cathode of light emitting diode string, and a gate configured to receive the dimming output pulse-width-modulation signal; and a second resistor coupled between a source of the dimming switch and the ground potential.

5. The load driving apparatus of claim 4, wherein the compensation circuit comprises:

a second capacitor having a first terminal coupled to the compensation pin; and a third resistor coupled between a second terminal of the second capacitor and the ground potential.

6. The load driving apparatus of claim 5, wherein the control chip comprises:

an operational transconductance amplifier configured to receive a cross-voltage of the second resistor and a predetermined dimming reference voltage, so as to generate the compensation voltage accordingly;

a gate signal generation unit coupled to the operational transconductance amplifier, and configured to receive the compensation voltage and the ramp signal and compare the compensation voltage with the ramp signal in response to the enabling of the dimming input pulse-width-modulation signal, so as to generate the gate pulse-width-modulation signal;

a dimming signal generation unit configured to receive the dimming input pulse-width-modulation signal and buffer-output the dimming input pulse-width-modulation signal, so as to generate the dimming output pulse-width-modulation signal; and a switching unit coupled the operational transconductance amplifier, and configured to receive the compensation voltage and transfer the compensation voltage to the compensation pin in response to the enabling of the dimming input pulse-width-modulation signal, wherein the switching unit is further configured to stop transferring the compensation voltage to the compensation pin in response to the disabling of the dimming input pulse-width-modulation signal, wherein the gate signal generation unit is further configured to stop generating the gate pulse-width-modulation signal in response to the disabling of the dimming input pulse-width-modulation signal.

7. The load driving apparatus of claim 6, wherein the switching unit is implemented by at least adopting a combination of a transmission gate and an inverter.

8. The load driving apparatus of claim 6, wherein the switching unit is implemented by at least adopting a transistor switch.

9. The load driving apparatus of claim 6, wherein:

the control chip further has a gate output pin, and the gate signal generation unit outputs the gate pulse-width-modulation signal via the gate output pin to control switching of the power switch;

the control chip further has a dimming input pin, and the dimming signal generation unit receives the dimming input pulse-width-modulation signal via the dimming input pin;

the control chip further has a dimming output pin, and the dimming signal generation unit outputs the dimming output pulse-width-modulation signal via the dimming output pin to control switching of the dimming switch; and the control chip further has a dimming detection pin, and the operational transconductance amplifier receives the cross-voltage of the second resistor via the dimming detection pin.

10. The load driving apparatus of claim 6, wherein the gate signal generation unit is further configured to determine whether to activate an over current protection mechanism in response to a cross-voltage of the first resistor and a predetermined over current protection reference voltage, wherein the gate signal generation unit is further configured to stop generating the gate pulse-width-modulation signal in response to the activation of the over current protection mechanism.

11. The load driving apparatus of claim 6, wherein the control chip further has a current sense pin, and the gate signal generation unit receives the cross-voltage of the first resistor via the current sense pin.

12. The load driving apparatus of claim 6, further comprising:

an output feedback unit coupled between the DC output voltage and the ground potential, and configured to provide a feedback voltage relating to the DC output voltage, wherein the gate signal generation unit is further configured to determine whether to activate an over voltage protection mechanism in response to the feedback voltage and a predetermined over voltage protection reference voltage, wherein the gate signal generation unit is further configured to stop generating the gate pulse-width-modulation signal in response to the activation of the over voltage protection mechanism.

13. The load driving apparatus of claim 12, wherein the output feedback unit comprises:

a fourth resistor having a first terminal configured to receive the DC output voltage, and a second terminal configured to provide the feedback voltage; and a fifth resistor coupled between the second terminal of the fourth resistor and the ground potential.

14. The load driving apparatus of claim 12, wherein the control chip further has a voltage sense pin, and the gate signal generation unit receives the feedback voltage via the voltage sense pin.

15. The load driving apparatus of claim 3, wherein:

the control chip further has a power pin configured to receive the DC input voltage required for operations, and the control blade further has a ground pin coupled to the ground potential.

* * * * *